US007134945B2

(12) United States Patent
Alexander

(10) Patent No.: US 7,134,945 B2
(45) Date of Patent: Nov. 14, 2006

(54) SODA BLASTING APPARATUS

(76) Inventor: Joe Alexander, 1108 N. 9th St., Walla Walla, WA (US) 99362

( * ) Notice: Subject to any disclaimer, the term of this patent is extended or adjusted under 35 U.S.C. 154(b) by 0 days.

(21) Appl. No.: 11/051,714

(22) Filed: Feb. 4, 2005

(65) Prior Publication Data

US 2006/0178091 A1 Aug. 10, 2006

(51) Int. Cl.
*B24C 3/00* (2006.01)

(52) U.S. Cl. ..... 451/75; 451/91; 451/99

(58) Field of Classification Search ..... 451/75, 451/85, 86, 89, 90, 91, 92, 95, 99
See application file for complete search history.

(56) References Cited

U.S. PATENT DOCUMENTS

| | | | | |
|---|---|---|---|---|
| 4,646,482 | A * | 3/1987 | Chitjian | 451/87 |
| 4,878,320 | A | 11/1989 | Woodson | |
| 5,054,249 | A | 10/1991 | Rankin | |
| 5,081,799 | A | 1/1992 | Kirschner et al. | |
| 5,083,402 | A | 1/1992 | Kirschner et al. | |
| 5,099,619 | A | 3/1992 | Rose | |
| 5,230,185 | A | 7/1993 | Kirschner et al. | |
| 5,431,594 | A | 7/1995 | Shank, Jr. | |
| 5,556,324 | A * | 9/1996 | Shank, Jr. | 451/89 |
| 5,556,325 | A | 9/1996 | Shank, Jr. | |
| 5,588,901 | A | 12/1996 | Rubey, III et al. | |
| 6,083,001 | A | 7/2000 | Deardon et al. | |
| 6,347,984 | B1 | 2/2002 | Groman | |
| 2005/0003747 | A1* | 1/2005 | Dore | 451/90 |
| 2005/0085165 | A1* | 4/2005 | Troia et al. | 451/38 |

* cited by examiner

*Primary Examiner*—Jacob K. Ackun, Jr.
(74) *Attorney, Agent, or Firm*—Floyd E. Ivey; Lielber, Ivey, Connor, Berry & St. Hilaire

(57) ABSTRACT

The Soda Blasting Apparatus (1) disclosed and claimed herein introduces pressure into a pressure vessel (10). The blasting medium (70) is metered from the pressure vessel interior (13) by a pressure differential introduced by a venture (500) positioned at the pressure vessel interior (13) proximal the pressure vessel bottom (12) and in pressure communication with a pass through pipe (400). The pass through pipe (400) receives pressure proximal the pass through pipe top (440). The venturi (500) has a venturi aperture (590) having a venturi aperture ID D6 (585). The venturi aperture ID D6 (585) is less than the pass through pipe ID D7 (410). The venturi aperture (590) is in pressure communication with the pass through pipe aperture (410). The venturi pressure Pb (575) is less than the pass through pipe pressure Pa (480) as a result of the venturi effect between the pass through pipe (400) and the venturi (500). At the venturi outer surface, at least one venturi groove (530) is formed from the venturi top (510) to the venturi bottom (520). The venturi (500) is received into a medium outlet (600) which is fixed by pipe and thread means at the pressure vessel bottom (12) and which has a medium outlet ID D5 (650). The venturi diameter OD D3 (570) is approximately three thousandths inches less than the medium outlet ID D5 (650). The venturi (500) is in pressure communication with the medium outlet (600) and medium out elbow (700) which is in pressure communications with a hose and nozzle for the delivery of blasting medium to a surface.

9 Claims, 9 Drawing Sheets

SODA BLASTING APPARATUS

FIELD OF THE INVENTION

This invention relates to an apparatus containing and delivering a blasting medium to a surface for polishing, abrading and or removal of an outer layer or material from a surface. The invention more specifically relates to an apparatus for metering of the blasting medium, including sodium bicarbonate, and the delivery of the blasting medium into the stream to be directed to the surface.

BACKGROUND OF THE INVENTION

Blasting equipment is well known in the prior art. Devices and apparatuses pertaining to blasting equipment are seen in the following patents: U.S. Pat. Nos. 5,230,185; 5,083,402 and 5,081,799 to Kirschner et al.; U.S. Pat. No. 5,431,594 to Shank, Jr.; U.S. Pat. No. 5,588,901 to Rubey, III et al; U.S. Pat. No. 5,099,619 to Rose; U.S. Pat. No. 6,347,984 to Groman; U.S. Pat. No. 6.083,001 to Deardon et al; U.S. Pat. No. 4,878,320 to Woodson; U.S. Pat. No. 5,556,325 to Shank, Jr.; U.S. Pat. No. 5,054,249 to Rankin.

The patents referred to herein are provided herewith in an Information Disclosure Statement in accordance with 37 CFR 1.97.

SUMMARY OF THE INVENTION

The Soda Blasting Apparatus (1) disclosed and claimed herein introduces pressure into a pressure vessel (10) at the pressure vessel interior (13) proximal the pressure vessel top (11). The blasting medium (70) is metered from the pressure vessel interior (13) by a pressure differential introduced by a venture (500) positioned at the pressure vessel interior (13) proximal the pressure vessel bottom (12) and in pressure communication with a pass through pipe (400). The pass through pipe (400) receives pressure proximal the pass through pipe top (440) at the pass through pressure aperture (430) having a pass through pipe ID D7 (410). The venturi (500) has a venturi aperture (590) having a venturi aperture ID D6 (585). The venturi aperture ID D6 (585) is less than the pass through pipe ID D7 (410). The venturi aperture (590) is aligned with and is in pressure communication with the pass through pipe aperture (410). The venturi pressure Pb (575) is less than the pass through pipe pressure Pa (480) as a result of the venturi effect between the pass through pipe (400) and the venturi (500). The venturi (500) has a venturi top (510), a venturi bottom (520) and a venturi outer surface (525). At the venturi outer surface, at least one venturi groove (530) is formed, by groove forming means, from the venturi top (510) to the venturi bottom (520). The venturi (500) has a venturi diameter OD D3 (570). The venturi (500) is received into a medium outlet (600) which is fixed by pipe and thread means at the pressure vessel bottom (12) and which has a medium outlet ID D5 (650). The venturi diameter OD D3 (570) is approximately three thousandths inches less than the medium outlet ID D5 (650). The venturi (500) is in pressure communication with the medium outlet (600) which is in pressure communication with a hose and nozzle for the delivery of blasting medium to a surface. The pass through pipe (400) and venturi (500) are slidably received into the pressure vessel (10) thereby allowing upward movement of the pass through pipe (400) and venturi (500) as pressure is applied to the pass through pipe (400) and the pressure vessel interior (13) with the upward movement limited and controlled by movement limiting means (300) illustrated herein by a pass through pipe position adjustment (300). In the preferred embodiment the at least one venturi groove (530) has a uniform venturi groove first width W1 (550) proximal the venturi bottom (520) and the venturi groove second width W2 (555) proximal the venturi top (510). In the preferred embodiment the venturi groove first depth D1 (650) proximal the venturi bottom (520) is greater than the venturi groove second depth D2 (565) proximal the venturi top (510). Thus as upward movement of the pass through pipe (400) and venturi (500) occurs greater quantity of blasting medium is allowed to flow from the blasting apparatus (1) due to the pressure differential between the pressure vessel interior (13) and the lower pressure at the venturi aperture ID D6 (585) positioned in the medium outlet (600).

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figure 1:
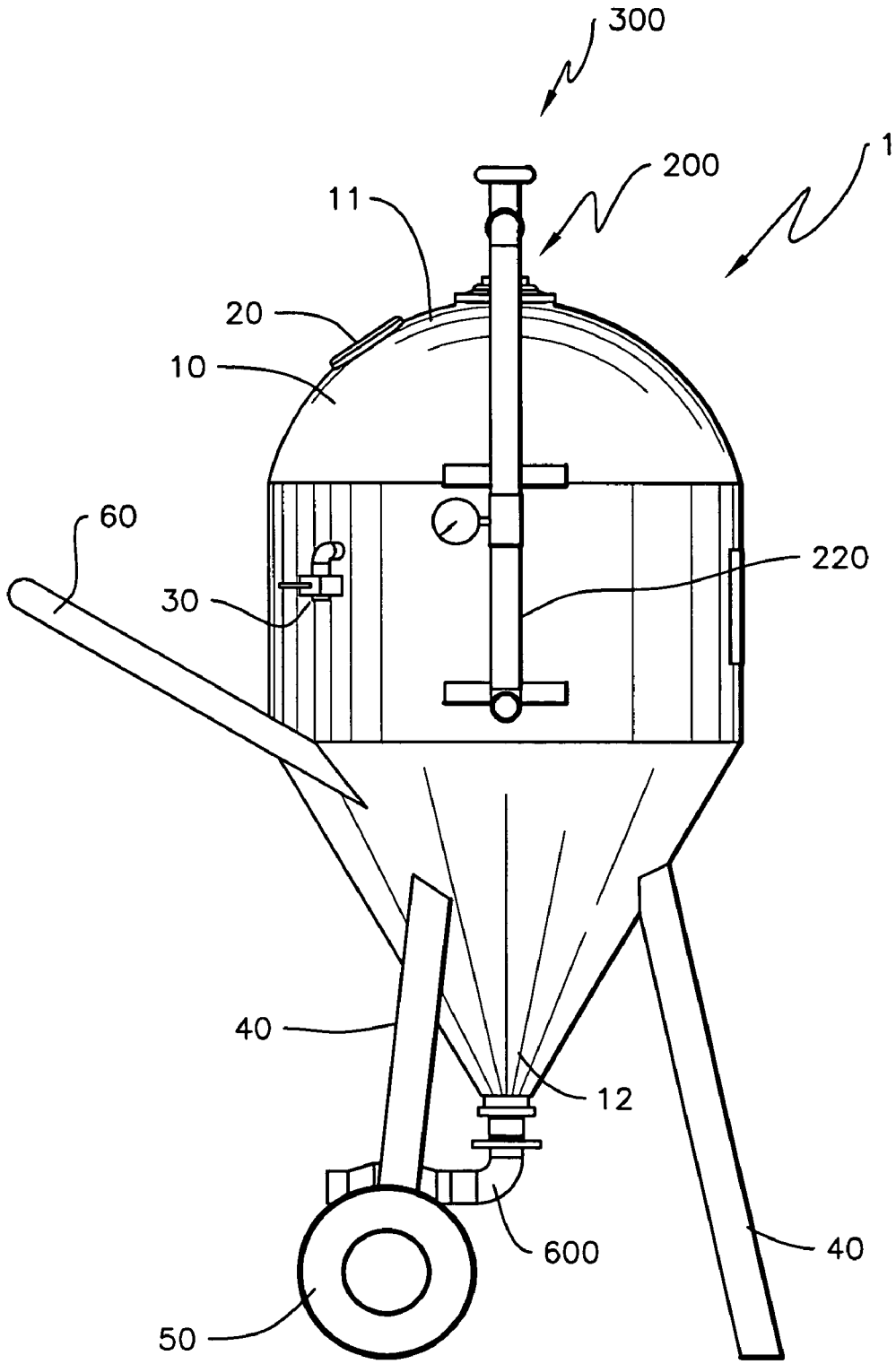
FIG. 1 is a side elevation of the blasting apparatus (1) showing a pressure vessel (10), pressure vessel top (11), pressure vessel bottom (12), a pass through retaining nut securing means (15), blasting medium fill opening/cap (20), pressure relief valve (30), support stand (40), wheels (50), a handle (60) and blasting medium (70). Also illustrated is a pressure inlet line (200) having a pressure inlet (210) and associated piping (220), flex piping (230), valve means including a check valve (240) and ball valve (250) in piping and pressure communication interconnected to pressurize the pressure vessel (10). Also illustrated is a medium outlet (600) and the pressure inlet line support (260).
Figure 1A:
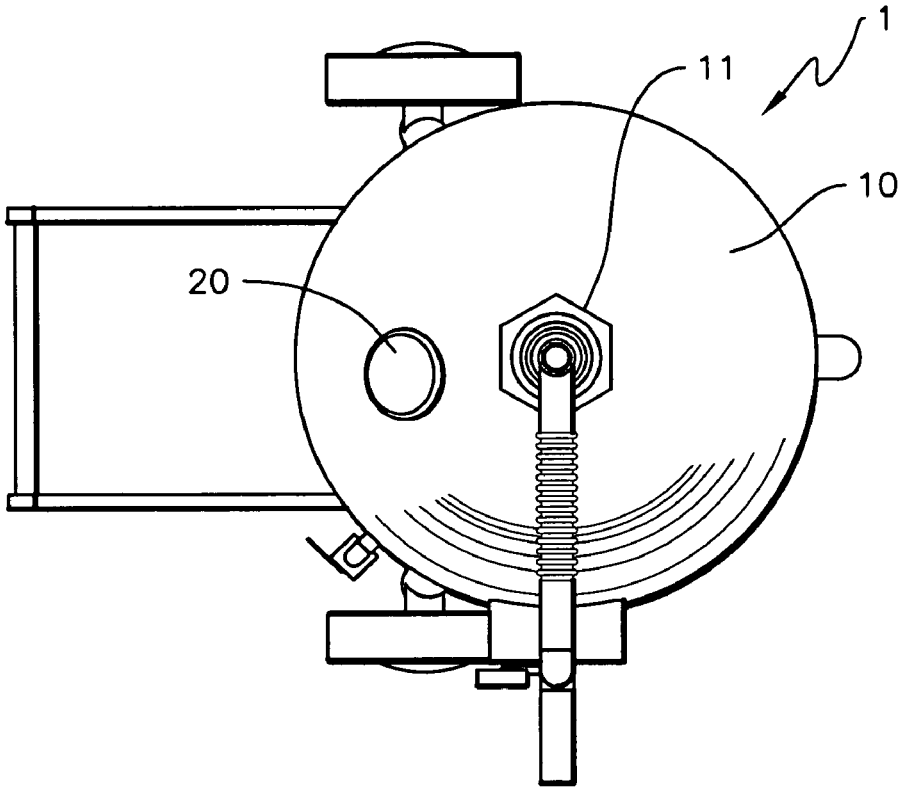
FIG. 1A illustrates the blasting apparatus (1) at the blasting apparatus top (11).
Figure 2:
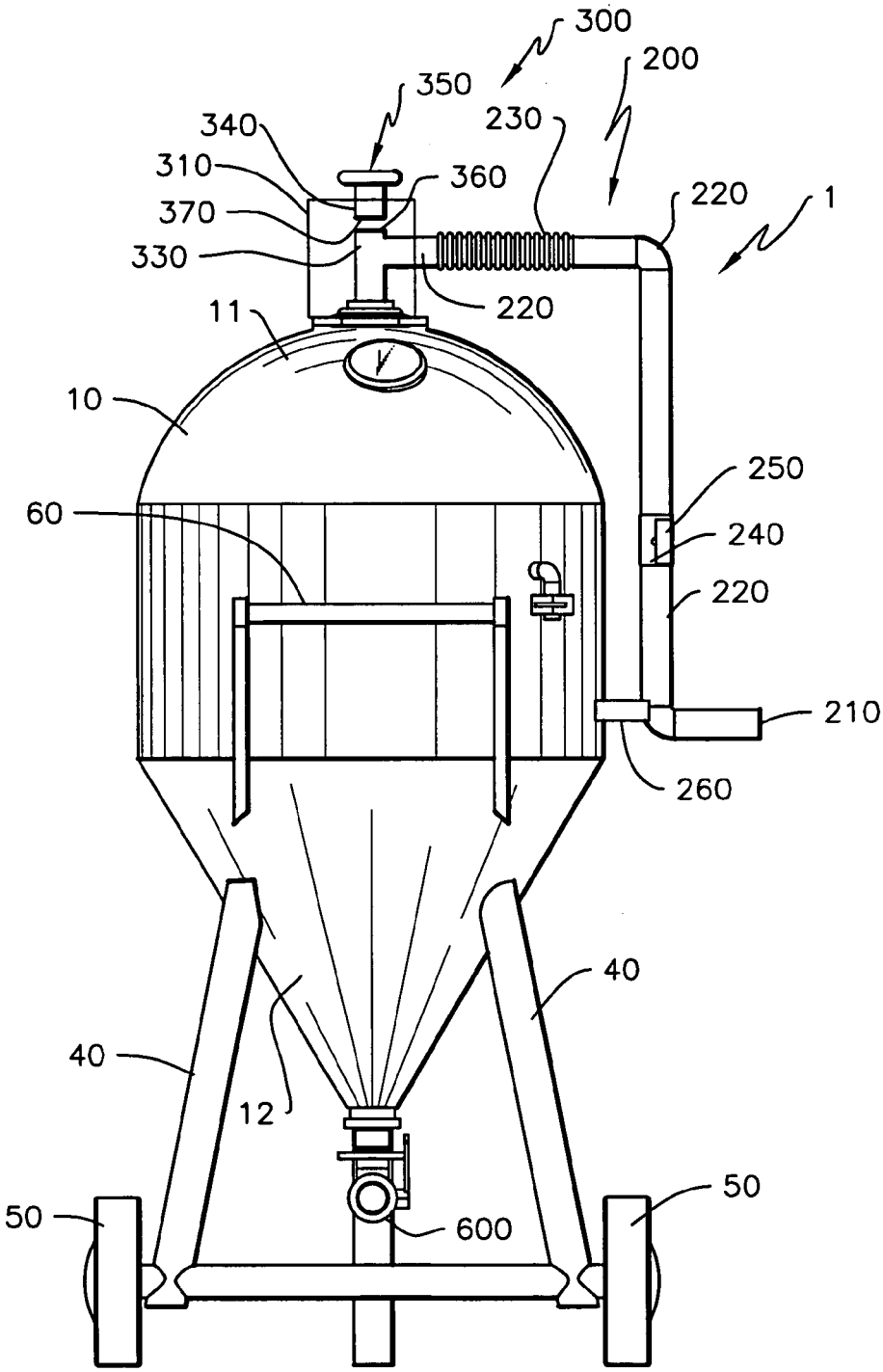
FIG. 2 is a rear elevation showing the blasting apparatus (1).

FIGS. 1, 1A, 2 and 3 illustrate the Blasting apparatus (1) showing a pressure vessel (10) having a pressure vessel top (11) and a pressure vessel bottom (12), a pass through retaining nut securing means (15), blasting medium fill opening/cap (20), pressure relief valve (30), support stand (40), wheels (50) and a handle (60). Also illustrated is a pressure inlet line (200) having a pressure inlet (210) and associated piping (220), flex piping (230), valve means including a check valve (240) and ball valve (250) in piping and pressure communication interconnected to pressurize the pressure vessel (10).

Figure 3:
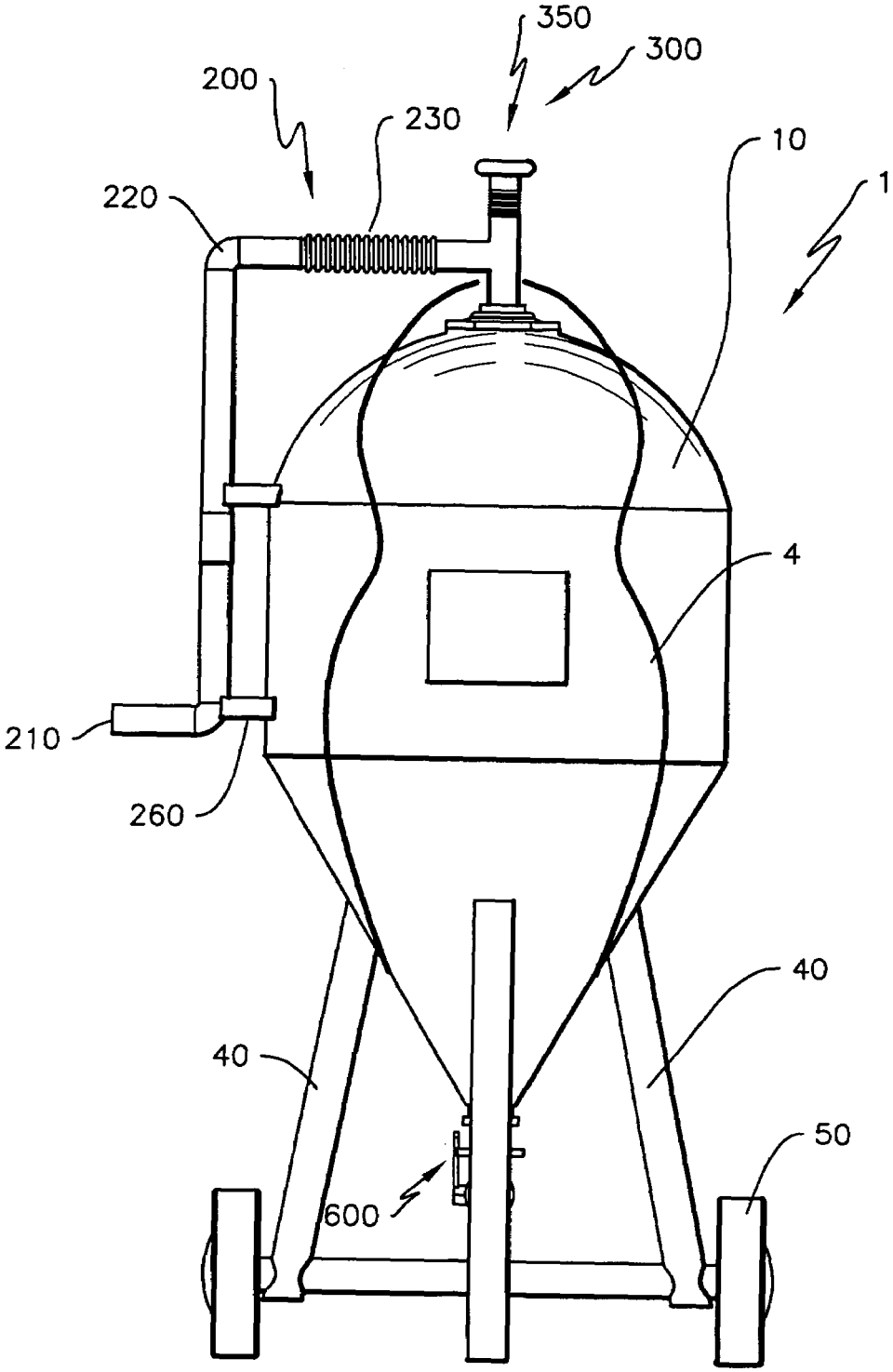
FIG. 3 is a front elevation showing the blasting apparatus (1).
Figure 4:
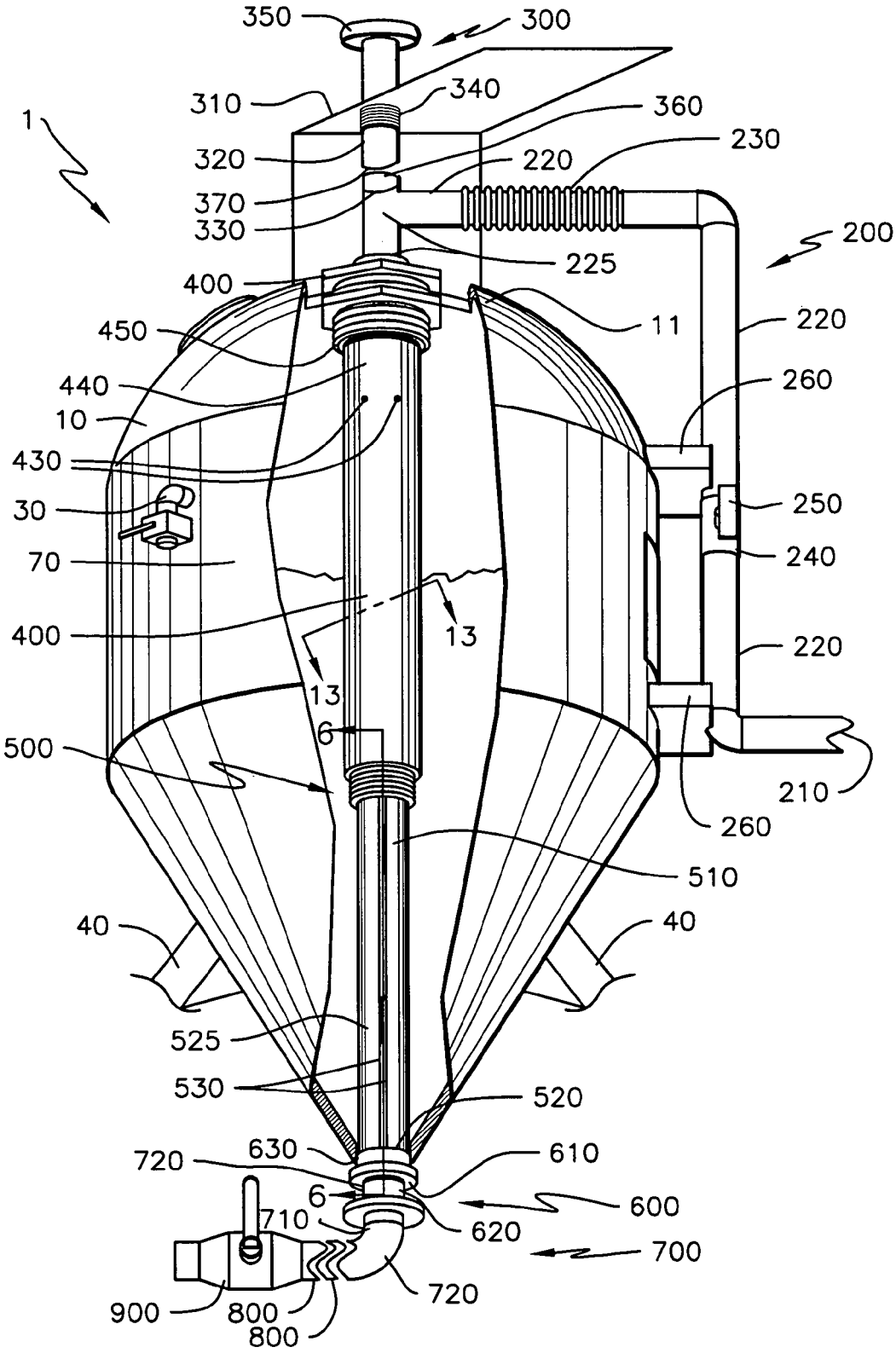
FIG. 4 is a cutaway view from FIG. 3 illustrating the pressure inlet line (200), pass through pipe position adjustment (300) with position adjustment bracket (310), position adjustment stem (320), position stop (330), position adjustment threads (340), position adjustment handle (350), pass through stop seat (360) and position adjustment stem seat (370). Also illustrated is the pass through pipe (400), venturi (500), medium outlet (600) and medium outlet elbow (700) and pressure vessel (10).

FIG. 4 is a cutaway of the pressure vessel 910) from FIG. 3. Seen is the interconnection of the pressure inlet line (200) with a pass through pipe (400), venturi (500), pass through pipe position adjustment (300), pass through pipe (400), venturi (500), medium outlet (600) and medium outlet elbow (700).

The pass through pipe (400) is cylindrical and is contained within the pressure vessel (10) by piping and pressure containment means including O-Ring means with associated O-ring seats and retainer nut means. In the preferred embodiment pass through pipe "O" ring seat and thread means (450) provides a pass through pipe "O" ring seat aperture (455) which seatedly receives a pass through pipe "O" ring (470) with a pass through pipe "O" ring retainer nut (460) secured generally by removal nut/thread means to thread means at the pass through pipe "O" ring seat and thread means (450). Those of ordinary skill in the O-Ring arts will appreciate that seating of "O"-ring is well known in the arts and that alternative seating structures will be available for the application demonstrated herein. In the preferred embodiment has a pass through pipe "O" ring ID D6 (475).

In the preferred embodiment the pass through pipe (400) is received at the pressure vessel top (11) pass through pipe "O" ring retainer nut (460), the pass through pipe "O" ring (470) and the pass through pipe "O" ring seat aperture (455). The pass through pipe (400) is in pressure sealing communication with the pass through pipe "O" ring (470) to permit pressurization of the pressure vessel (10). The pass through pipe (400) is movable or slidably related to the pass through pipe "O" ring (470) allowing the pass through pipe (400) to be urged upward as pressure is applied to the pressure vessel (10) and the pass through pipe (400) and downwardly when pressure is released from the pressure vessel via the pressure relief valve (30).

As seen in FIG. 4, pressure is introduced to the pass through pipe (400) by pipe connection means between the pass through pipe (400), at the pass through pipe top (440) proximal the pressure vessel top (11), and the pressure inlet line (200) piping (220) proximal the pressure vessel top (11). Pipe connection means (225) includes Pipe Nipples and Fittings and Pipe Trees. The pressure inlet line (200) has a flexible piping means, seen FIG. 4 as flex piping (230), proximal the interconnection of the pass through pipe (400) and the pressure inlet line (200) such that movement of the pass through pipe (400) will not be constrained by the pressure inlet line (200). The pressure inlet line (200) is affixed by pipe hanging means to the pressure vessel (10) or related support stand (40) or handle (60) structure. Illustrated is a bracket seen as one or more pressure inlet line support (260) generally comprised of a rigid material connected by mechanical means, including welding and brackets, to the pressure vessel (10) and piping (220).

Figure 5:
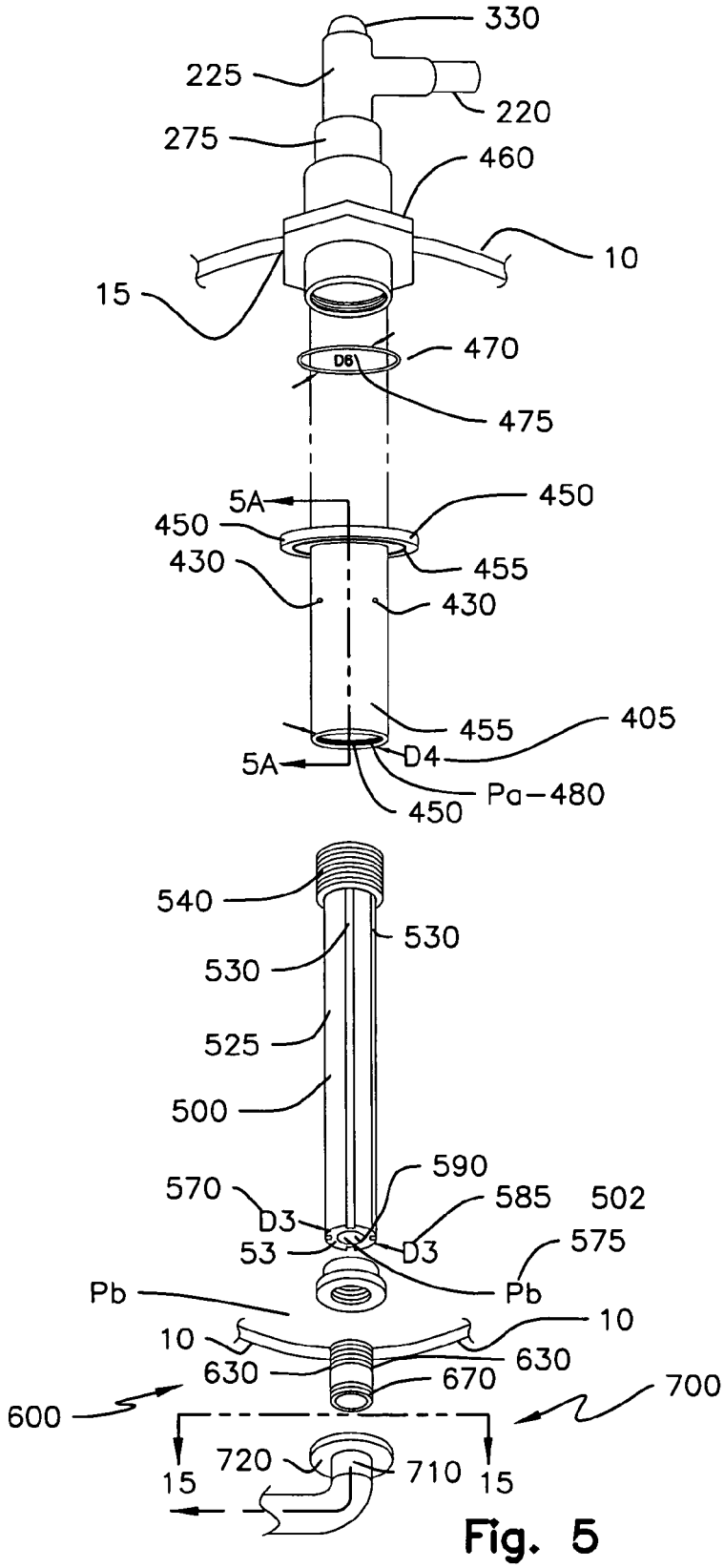
FIG. 5 is an exploded view of the pass through pipe (400), the venturi (500), the medium outlet (600) and the medium outlet elbow (700). Shown is the pass through pipe OD D4 (405), pass through pressure aperture (430), pass through pipe top (440), pass through pipe bottom (445), pass through pipe "O" ring ID D6 (475), pass through thread means (450), pass through pipe "O" Ring, pass through pipe "O" Ring diameter D6 (475) and pass through pipe pressure Pa (480). Also illustrated is the venturi (500. Also seen is the medium outlet (600), medium outlet flange (610), medium outlet pipe (620), medium outlet pressure vessel threads (630), medium outlet ID D5 (650), medium outlet cap threads (670). Also illustrated is the medium outlet elbow (700).
Figure 6:
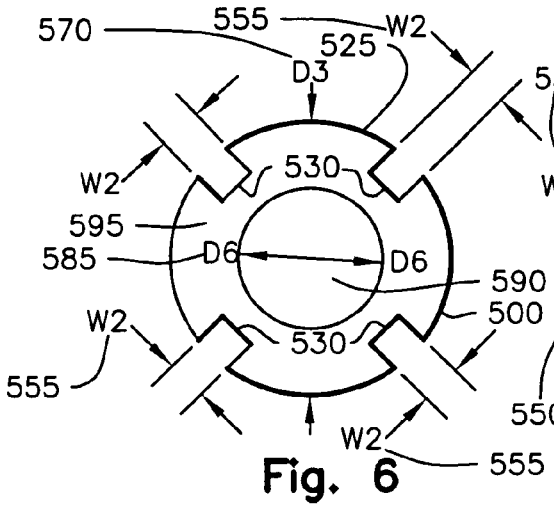
FIGS. 6, 7, 8 and 9 illustrate the venturi groove (530) at the venturi top (510) and venturi bottom (520) demonstrating the venturi groove first width W1 (550), venturi groove second width W2 (555), venturi groove first depth D1 (560), venturi groove second depth D2 (565), venturi diameter OD D3 (570), venturi pressure Pb (575), venturi aperture (590), venturi aperture ID D6 (585) and venturi top surface (595).
Figure 7:
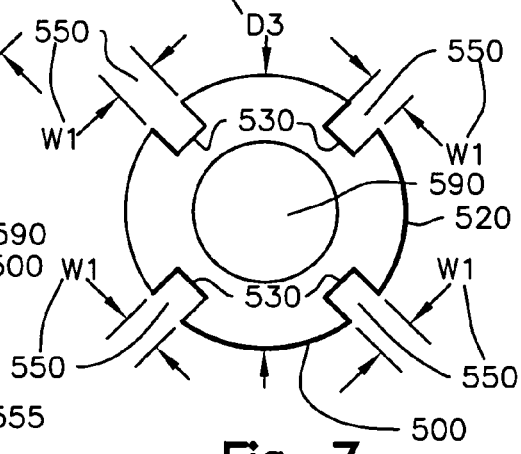
Figure 8:
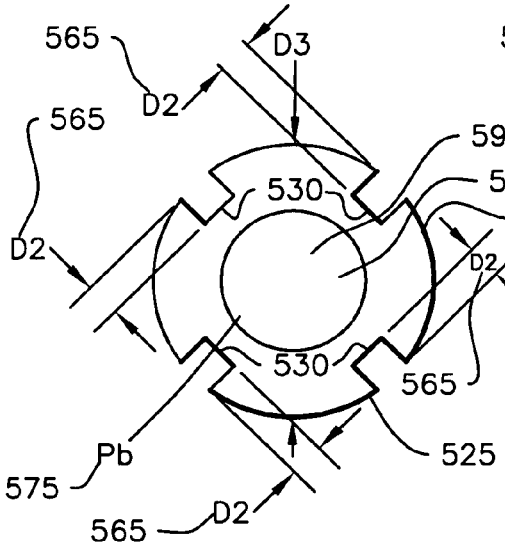
Figure 9:
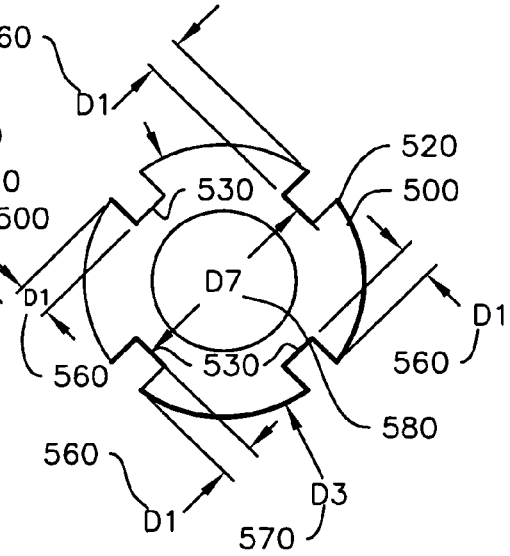
Figure 10:
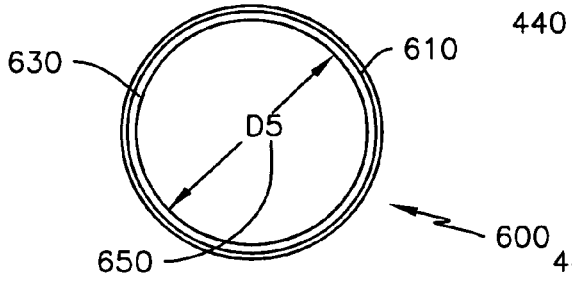
FIG. 10 is the top plan view of the medium outlet (600) showing the medium outlet flange (610), the medium outlet pressure vessel threads (630) and the medium outlet ID D5 (650).

Shown in FIGS. 4 and 5, the pass through pipe (400) has a pass through pipe bottom(445) distal from the pass through pipe top (440). In the preferred embodiment the pass through pipe (400) has at least one pass through pressure aperture (430) intermediate the pass through pipe top (440) and the pass through pipe bottom (445). In the preferred embodiment the at least one pass through pressure aperture (430) is positioned at the pressure vessel interior (13) proximal the pressure vessel top (11). The pass through pressure aperture (430) is in pressure communication between the pass through pipe (400) and the pressure vessel interior (13). In the preferred embodiment there are at least two pass through pressure apertures (430), as illustrated in FIG. 4, with a diameter 5/32 inches.

In the preferred embodiment the principal structural materials for the pressure vessel (10), the pass through pipe (400), the venturi (500), the medium outlet (600) and the medium outlet elbow (700) are rigid pressure containing materials including metals and including stainless steel. As seen in FIGS. 4 through 10 and 15, the pass through pipe (400), the venturi (500), the medium outlet (600) and the medium outlet (700) are cylindrical with each generally having the same cross-section shape which will, in the preferred embodiment be circular.

As seen in FIGS. 4 through 10, a venturi (500) is generally cylindrical having a venturi top (510). The venturi (500) at the venturi top (510) is aligned with and affixed, by mechanical or piping means, including threaded means, in pressure communication with the pass through pipe (400) at the pass through pipe bottom (445). The venturi (500) has at least one venturi groove (530) from the venturi top (510) to the venturi bottom (520). In the preferred embodiment there are at least four venturi grooves (530) from the venturi top (510 to the venturi bottom (520), however, alternative embodiments will have "n" groves. The at least one venturi groove (530) has a venturi groove first width W1 (550) proximal the venturi bottom (520) and a venturi groove second width W2 (555) proximal the venturi top. In the preferred embodiment the venturi groove first width W1 (550) is equal to the venturi groove second width W2 (555). In alternative embodiments the venturi groove first width W1 (550) is greater or lesser than the venturi groove second width W2 (555).

FIGS. 6–9, 12 and 14 depict the at least one venturi groove (530). The at least one venturi groove (530) has a venturi groove first depth D1 (560) proximal the venturi bottom (520) and a venturi groove second depth D2 (565) proximal the venturi top (510). In the preferred embodiment the venturi groove first depth D1 (560), proximal the venturi bottom (520), is greater than the venturi groove second depth D2 (565), proximal the venturi top. In alternative embodiments the venturi groove first depth D1 (560), proximal the venturi bottom (520), is less or greater than the venturi groove second depth D2 (565), proximal the venturi top.

The venturi (500) as a circular cross section cylinder, has a diameter or as a square cross section cylinder, has a side measurement identified herein as venturi diameter OD D3 (570). A medium outlet (600) is generally cylindrical and is formed with the same cylindrical cross section as composes the venturi (500). The medium outlet (600) has a medium outlet ID D5 (650) larger than the venturi diameter OD D3 (560). The medium outlet (600) is affixed by pressure containing and piping means at the pressure vessel bottom (12). Pressure containing and piping means includes threaded means and piping, welding and threaded means in the pressure vessel (10) at the pressure vessel bottom (12). In the preferred embodiment the medium outlet (600) is composed of pipe having a medium outlet flange (610) with medium outlet pressure vessel threads (630) which are pressure sealing received by threaded means in the pressure vessel bottom (12). The medium outlet (600) is aligned with the venturi (500) and receives the venturi (500) at the venturi bottom (520).

Figure 11:
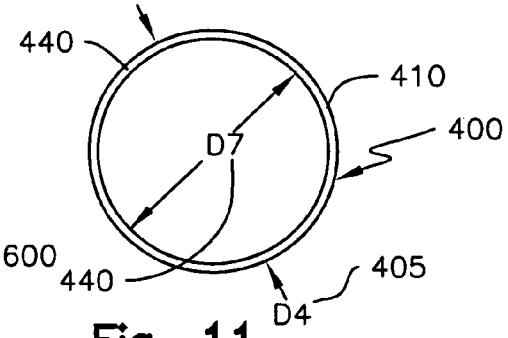
FIG. 11 is a top plan view of the pass through pipe (400) illustrating the pass through pipe OD (405) and the pass through pipe top (440).
Figure 12:
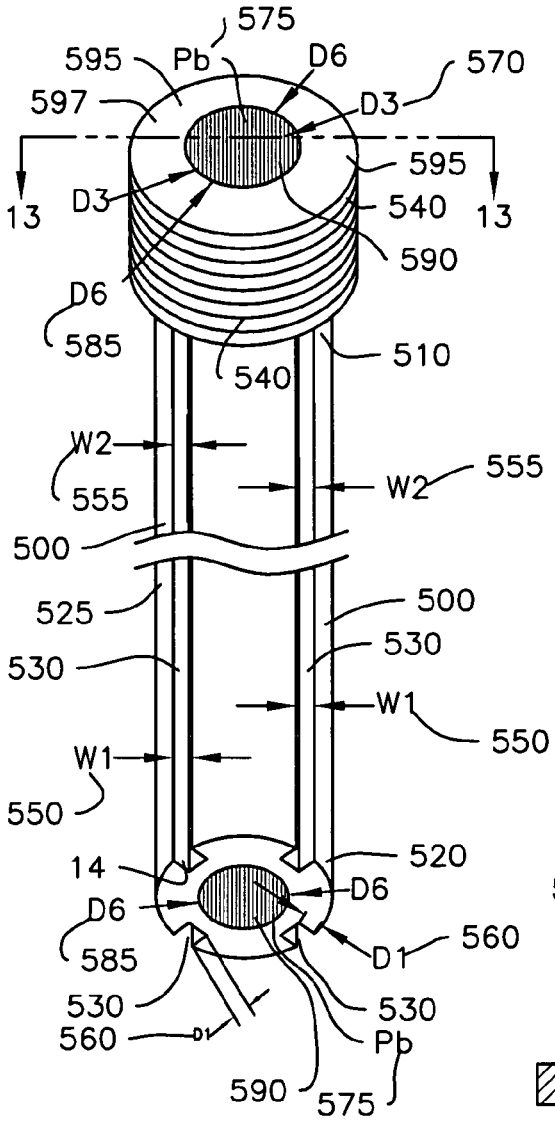
FIG. 12 is a elevation perspective showing the venturi (500) with venturi top (510), venturi bottom (520), venturi groove (530), venturi threads (540), venturi groove first width W1 (550), venturi groove second width W2 (555), venturi groove first depth D1 (560), venturi diameter OD D3 (570), venturi pressure Pb (575), venturi aperture ID D6 (585), venturi aperture (590) and venturi top surface (595).
Figure 13:
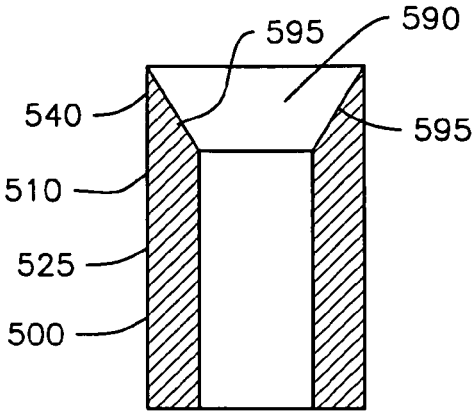
FIG. 13 is a vertical section from FIG. 12 illustrating the venturi (500) with venturi top surface (595) at the venturi aperture (590) proximal the venturi threads (540). The venturi tope surface (595) is illustrated as a chamfer or chamfered surface identified as venturi chamfer (597).
Figure 14:
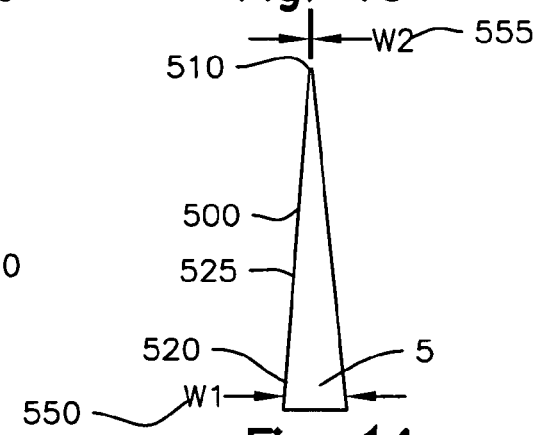
FIG. 14 is a vertical section from FIG. 12 illustrating the venturi groove (530) extending from proximal the venturi top (510) to proximal the venturi bottom (520). Illustrated is the venturi groove first depth D1 (560) and venturi groove second depth D2 (565).
Figure 15:
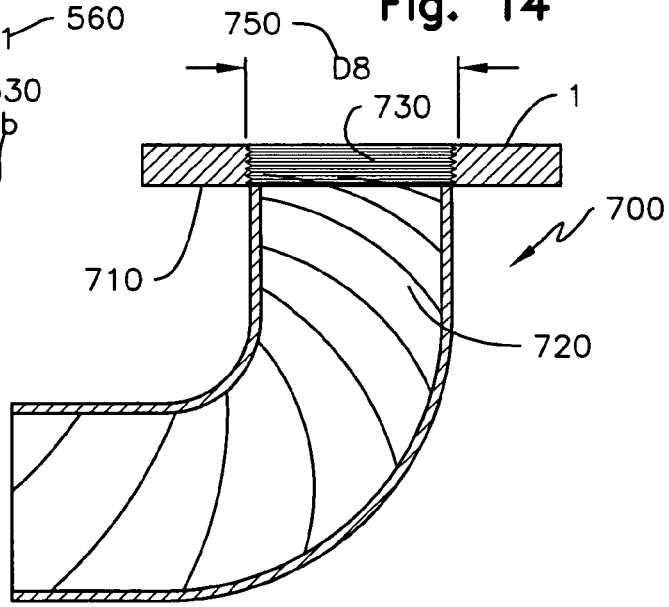
FIG. 15 is a vertical section from FIG. 5 showing the medium outlet elbow (700), the medium outlet elbow flange (710), medium outlet elbow interior surface (720), medium outlet elbow threads (730) and medium outlet elbow rifling (740).
Figure 16:
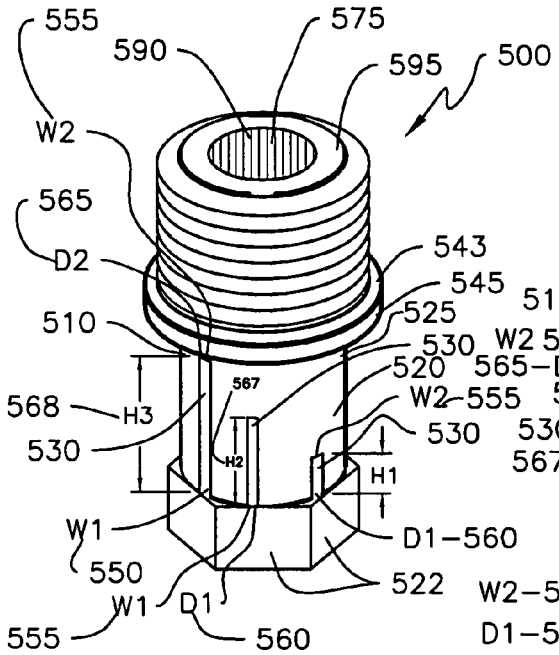
FIG. 16 is a front perspective elevation showing the venturi (500) with venturi top (510), venturi bottom (520), venturi grooves (530), venturi threads (540), venturi groove first height H1 (566), venturi groove second height H2 (567), venturi groove third height H3 (568) and venturi aperture (590). This view illustrates the venturi (500) at the venturi top surface (595) which may be flat or chamfered.
Figure 18:
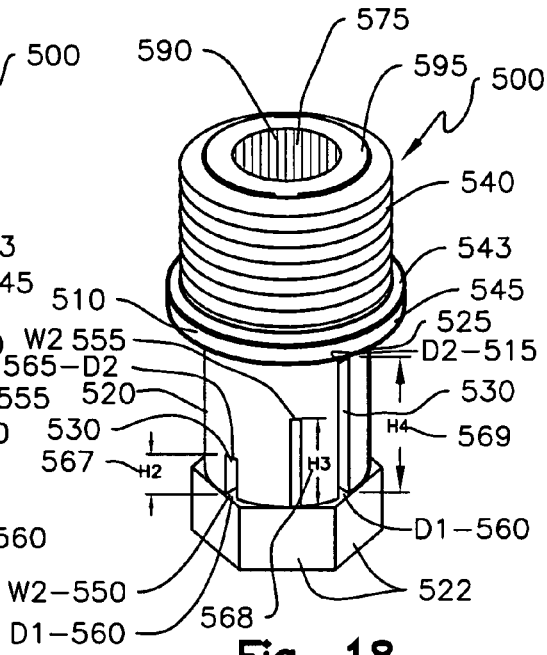
FIG. 18 is a front perspective elevation showing the venturi (500) with venturi top (510), venturi bottom (520), venturi grooves (530), venturi threads (540), venturi groove second height H2 (567), venturi groove third height H3 (568), venturi groove fourth height H4 (569) and venturi aperture (590). This view illustrates the venturi (500) at the venturi top surface (595) which may be flat or chamfered as venturi chamfer (597).

Seen in FIGS. 5, 11 and 12, the venturi aperture (590), in alignment with the pass through pipe (400), has a venturi aperture ID D6 (585) which is less than the pass through pipe ID D7 (510) thus creating a venturi when pressure is introduced into the pass through pipe (400) and allowed to pass through the venturi (500) and be discharged through the medium outlet (600) and the medium outlet elbow (700). The venturi (500) proximal the venturi top (510) is chamfered at the venturi aperture (590) thus reducing pressure and flow restrictions as fluid flows through the pass through pipe (400) and into and through the venturi aperture (590). Also seen is the venturi top surface (595) which may be flat or formed with a chamfer and shown as a venturi chamfer (597) in FIG. 13.

Figure 17:
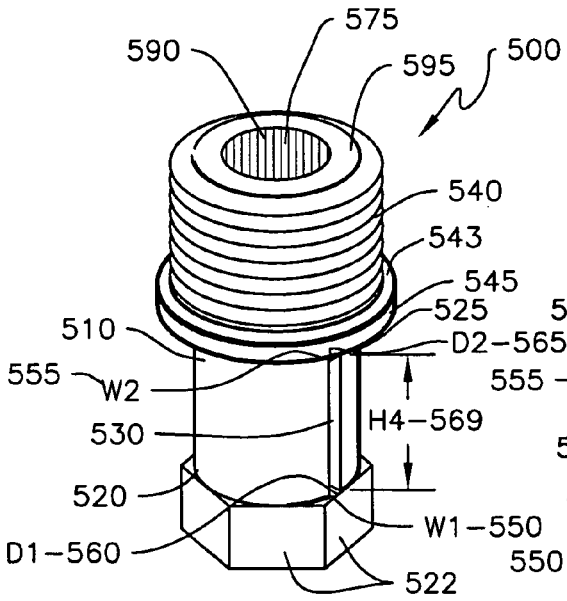
FIG. 17 is a rear perspective elevation from FIG. 16 showing venturi groove fourth height H4 (596).
Figure 19:
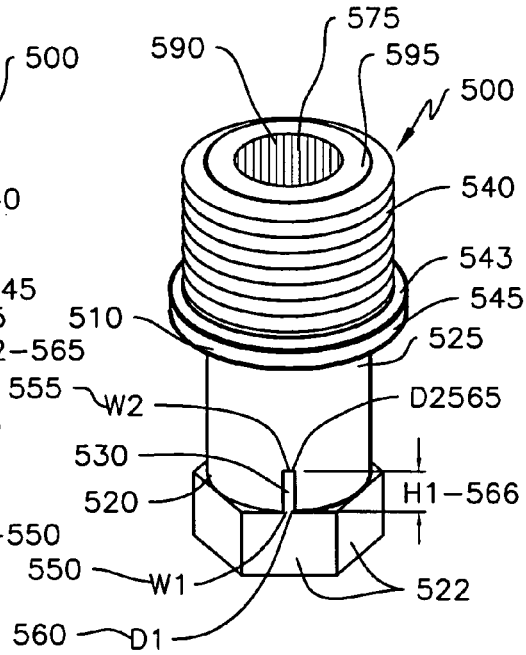
FIG. 19 is a rear perspective elevation from FIG. 18 showing venturi groove fourth first H1 (566). , venturi groove first height H1 (566).

FIG. 16, FIG. 17, FIG. 18 and FIG. 19 illustrate alternative embodiments of at least one venturi groove (530). For illustrative purposes at least four venturi grooves (530) are shown having venturi groove first height H1 (566), venturi groove second height H2 (567), venturi groove third height (568) and venturi groove fourth height H4 (569). Venturi groove first height H1 (566), venturi groove second height H2 (567), venturi groove third height H3 (568) and venturi groove fourth height H4 (569) extend from the venturi bottom (520) on the venturi outer surface (525) toward the venturi top (510) and terminates intermediate the venturi top (510) and the venturi bottom (520). Also illustrated are at least one venturi flat (522) proximal the venturi bottom (520) for wrench tighting means. Shown are at least two venturi flats (522). Also illustrated is a staggered or unequally spaced arrangement of the venturi grooves (530) where FIG. 17 and FIG. 19 are rear views or views rotated 180 degrees from FIG. 16 and FIG. 18 respectively. Venturi groove first height H1 (566), venturi groove second height H2 (567), venturi groove third height H3 (568) and venturi groove fourth height H4 (569) may be equal or unequal in height. In an alternative embodiment the venturi groove first width W1 (550) and the venturi groove second width W2 (555) and 1/32" and the venturi groove first depth D1 (560) is 0.0" and the venturi groove second depth D2 (565) is 1/16".

In the preferred embodiment the blasting medium (70) ranges from fifteen thousandths inches to approximately seven thousandths inches. The pressure in the pressure vessel interior (13) and in the pass through pipe (400) is approximately 150 psi. The pass through pipe (400), as well as the other components of the blasting apparatus (1) which are subject to blasting medium (70), pressure and the flow of blasting medium (70) are constructed from metal and, in the preferred embodiment from stainless steel. The pass through pipe, in the preferred embodiment is machine trued to three to eight thousandths inches and is twenty-six inches in length. The machine truing of the pass through pipe allows ease of assembly of the pass through pipe (400) as it is received by a pass through pipe "O" ring (470) which both retains pressure in the pressure vessel (10) and allows a slidable relationship with the pass through pipe (400) for upward and downward movement of the pass through pipe ID (400) and the venturi (500). In the preferred embodiment the pass through pipe ID D7 (410) is 1.0", the venturi diameter OD D3 (570) is 1.060", the venturi aperture ID D6 (585) is 0.5", the medium outlet ID D5 (650) is 1.065", the medium elbow outlet ID D8 (750) is 1.000", the hose (800) is 0.75 " ID, and the nozzle (900) ID ranges from 1/8" to 3/8"; the venturi (500) movement is a maximum of 1.000 inches upward from a closed position of no flow. The hose and nozzle pressure relate to the nozzle size with the 1/8" nozzle having a reduction of pressure of approximately 3# with the 3/8" nozzle experiencing a pressure loss of approximately 20#. In the preferred embodiment the venturi (500) movement is a maximum of 1.000 inches upward from a closed position of no flow. The pass through pipe "O" Ring (470) allows the pass through pipe (400) to slide permitting upward and downward movement limited by the pass through pipe position adjustment (300).

The pass through pipe pressure Pa (480) is greater than the venturi pressure Pb (575) as the result of the venturi effect. The pressure in the pressure vessel interior (13) is equalized to that in the pass through pipe (400) by means of the pressure communication provided by the at least one pass through pressure aperture (430). The greater pressure of pipe pressure Pa (480) over that within the venturi (500) at the venturi aperture (590) exerts an upward force urging the pass through pipe (400), and attached venturi (500), upward toward the pressure vessel top (11). The upward movement of the pass through pipe (400) and venturi (500) causes an upward movement of the at least one venturi groove (530) relative to the fixed in place medium outlet (600). The pressure within the medium outlet (600) proximal the venturi bottom (520) is less than the pressure in the pressure vessel interior (13) thus causing pressure to be exerted on and urging the blasting medium (70) through the at least one venturi groove (530), into and through the medium outlet (600) and medium outlet elbow (700) and through a hose for application by a nozzle against a surface.

In the preferred embodiment the medium outlet ID D5 (650) is three thousandths inches (0.003") greater than the venturi diameter OD (570). In the preferred embodiment the blasting medium is approximately nine thousandths inches (0.009") in diameter or at its smallest dimension.

In the preferred embodiment the pressure is filled, at the blasting medium fill opening/cap (20) proximal the pressure vessel top (11), with blasting medium.

In the preferred embodiment the pass through pipe (400) will be urged upward as pressure is applied at the pressure inlet line (200), to the pressure vessel interior (13) and as flow is permitted through the venturi (500). The upward movement of the pass through pipe (400) is limited by a position adjustment (300) means illustrated here as a position adjustment bracket (31) receiving a position adjustment stem (320) and a position stop (330). The position adjustment stem (320) and the position stop (330) are shown as aligned rods with the position stop (330) attached by piping or other mechanical means to cause the position stop (330) to move in accord with the pass through pipe (400).

As the pass through pipe (400) is urged upwards, the position stop (330) will encounter the position adjustment stem (320) and terminate upper movement of the pass through pipe (400). The position adjustment stem (320) is a downwardly extending elongated member and the position stop (330) is an upwardly extending elongated member. In the preferred embodiment the position stop (330) at its most upward position will have a concave surface and the position adjustment stem (320), at its most downward position will have a convex surface such that the contact between the two will be to retain the members in alignment. The pass through pipe (400) interconnection, by pipe connection means, between the pass through pipe (400), at the pass through pipe top (440) proximal the pressure vessel top (11), and the pressure inlet line (200) piping (220) proximal the pressure vessel top (11) may be by use of a Pipe Tee means at the interconnection of the pass through pipe top (440) and the pressure inlet line (200) piping (220) proximal the pressure vessel top (11) where the cross member of a Pipe Tee means most distal to the pressure vessel top (11) may receive, by thread means, the position stop (330) for alignment with the position adjustment stem (320). The Tee portion of a Pipe Tee means may receive, by thread means, the piping (220) most proximal the pass through pipe top (440). Those of ordinary skills in mechanical and piping arts will appreciate equivalent mechanical means.

In the preferred embodiment the position adjustment stem (320) has threaded means shown in FIG. 4 as position adjustment threads (340) which are received by threaded means in position adjustment bracket (310). Handle means, depicted by FIG. 4 and identified as position adjustment handle (350) allow upward and downward adjustment of the position adjustment stem (320) thereby fixing the extent of upward movement of the pass through pipe (400).

While a preferred embodiment of the present invention has been shown and described, it will be apparent to those skilled in the art that many changes and modifications may be made without departing from the invention it is broader aspects. The appended claims are therefore intended to cover all such changes and modifications as fall within the true spirit and scope of the invention.

I claim:

1. A Soda Blasting Apparatus (1) comprising:

a. a pressure vessel (10), a pressure inlet line (200) in pressure communication interconnected by piping to a pass through pipe (400) to pressurize the pass through pipe (400) and the pressure vessel (10); the pressure vessel (10) having a pressure vessel top (11) and a pressure vessel interior (13);

b. the pass through pipe (400) rigidly interconnected by piping, and in pressure communications, with a venturi (500); the venturi received by and in pressure communication with a blasting medium outlet (600) at a pressure vessel bottom (12); the blasting medium outlet (600) interconnected by piping and in pressure communication with a blasting medium outlet elbow (700) a hose and nozzle connected to the outlet elbow (700) to allow application of blasting medium to a surface;

c. the pass through pipe (400) having a pass through pipe aperture (430) having a pass through pipe ID D7 (410); the venturi (500) having a venturi aperture (590) having a venturi aperture ID D6 (585) and a venturi diameter OD D3 (570); the blasting medium outlet (600) having a medium outlet ID D5 (650); the medium outlet elbow (700) having a medium outlet elbow ID D8 (750); the blasting medium outlet ID D5 (650) greater than the venturi diameter OD D3 (570); the venturi (500) movably received, at a venturi bottom (520) into the medium outlet (600);

d. the venturi aperture ID D6 (585) diameter less than the pass through pipe ID D7 (410) diameter creating, when the nozzle is activated allowing flow of blasting medium, a pressure differential between the pass through pipe aperture (430) and the venturi aperture (590), from a resulting venturi effect, whereby the pass through pipe pressure Pa (480) is greater than venturi pressure Pb (575);

e. the venturi (500) having a venturi top (510) and a venturi outer surface (525); at least one groove (530) at the venturi outer surface (525) from a point intermediate the venturi top (510) and the venturi bottom (520) to the venturi bottom (520); said at least one groove (530) allowing passage of blasting medium (70) from the pressure vessel interior (13) via the said at least one groove (530) resulting from the pass through pipe pressure Pa (480) being greater than venturi pressure Pb (575); the pressure differential urging the rigidly interconnected pass through pipe (400) and venturi (500) upward; the upward movement of the venturi (500) and at least one venturi groove (530), relative to the medium outlet (600), controllable and limited by movement limiting means (300) thereby allowing metering of the blasting medium (70) delivered to the hose and nozzle.

2. The apparatus of claim 1 further comprising:

a. the Soda Blasting Apparatus (1) introduces pressure, via the pressure inlet line (200) into the pressure vessel (10) at the pressure vessel interior (13) and into the pass through pipe (400) proximal the pressure vessel top (11);

b. blasting medium (70) is received into the pressure vessel interior (13) at a blasting medium fill opening/cap (20) proximal the pressure vessel top (11); blasting medium (70) is metered from the pressure vessel interior (13) by a pressure differential introduced by the venturi (500) positioned at the pressure vessel interior (13) proximal the pressure vessel bottom (12) and in pressure communication with the pass through pipe (400);

c. the pass through pipe (400) receives pressure proximal pass through pipe top (440) via a pass through pressure aperture (430) having a pass through pipe ID D7 (410); the venturi (500) has a venturi aperture (590) having a venturi aperture ID D6 (585); the venturi aperture ID D6 (585) is less than the pass through pipe ID D7 (410); the pass through pipe (400) has at least one pass through pressure aperture (430) intermediate the pass through pipe top (440) and the pass through pipe bottom (445) in pressure communication between the pass through pipe (400) and the pressure vessel interior (13);

d. the venturi aperture (590) is in pressure communication with the pass through pipe aperture (410); the venturi pressure Pb (575) is less than the pass through pipe pressure Pa (480) as a result of the venturi effect between the pass through pipe (400) and the venturi (500);

e. the at least one groove (530), being at least one venturi groove (530) and is formed by groove forming means including machining or molding, from the venturi top (510) to the venturi bottom (520);

f. the venturi (500), at the venturi bottom (520), is received into a medium outlet (600) which is fixed by piping at the pressure vessel bottom (12) and which has a medium outlet ID D5 (650); the venturi diameter OD D3 (570) is less than the medium ID D5 (650);

g. the venturi (500) is in pressure communication with the medium outlet (600) which is in pressure communication with the hose and nozzle for the delivery of blasting medium to a surface; the pass through pipe (400) and venturi (500) are slidably received into the pressure vessel (10) thereby allowing upward movement of the pass through pipe (400) and venturi (500) as pressure is applied to the pass through pipe (400) and the pressure vessel interior (13) with the movement limiting means (300) formed as a pass through pipe position adjustment (300);

h. the at least one venturi groove (530) has a venturi groove first width W1 (550) proximal the venturi bottom (520), a venturi groove second width W2 (555) proximal the venturi top (510), a venturi groove first depth D1 (560) proximal the venturi bottom (520) and a venturi groove second depth D2 (565) proximal the venturi top (510).

3. The apparatus of claim 2 further comprising:

a. the venturi diameter OD D3 (570) is approximately three thousandths inches less than the medium outlet ID D5 (650);

b. the pass through pipe (400) is pressure containingly received and slidably received into the pressure vessel (10) through a pass through pipe "O" Ring (470) proximal the pressure vessel top (11) and is affixed with piping and in pressure communication with the pressure inlet line (200); the at least one pass through pressure aperture (430) is positioned at the pressure vessel interior (13) proximal the pressure vessel top (11);

c. flex piping (230), provided by flexible and pressured containing piping means including metal, plastic and composite plastic and fabric flexible piping, is in piping and pressure communication with the pressure inlet line (200) and is proximal the pressure vessel top (11) and the interconnection of the pass through pipe (400) and the pressure inlet line (200); the flex piping (230) allowing upward movement of the pass through pipe (400) and venturi (500) as pressure is applied to the pass through pipe (400) and the pressure vessel interior (13);

d. the upward movement of the pass through pipe (400) is limited by a pass through pipe position adjustment (300) proximal the pass through pipe top (440);

e. the at least one venturi groove (530) venturi groove first width W1 (550) is equal to, less than or greater than the at least one venturi groove (530) venturi groove second width W2 (555); the at least one venturi groove (530) venturi groove first depth D1(560) is equal to, lesser than or greater than the venturi groove (530) venturi groove second depth D2 (565).

4. The apparatus of claim 3 further comprising:

a. the at least one venturi groove (530) has a venturi groove first width W1 (550) proximal the venturi bottom (520) equal to the venturi groove second width W2 (555) proximal the venturi top (510); the venturi groove first depth D1 (560) proximal the venturi bottom (520) is greater than the venturi groove second depth D2 (565) proximal the venturi top (510);

b. as upward movement of the pass through pipe (400) and venturi (500) occurs greater quantity of blasting medium is allowed to flow from the blasting apparatus (1) due to the pressure differential between the pressure vessel interior (13) and the lower pressure at the venturi aperture ID D6 (585) positioned in the medium outlet (600);

c. the at least one pass through pressure aperture (430) comprised of at least two pass through pressure apertures (430) in pressure communication between the pass through pipe (400) and the pressure vessel interior (13).

5. The apparatus of claim 4 further comprising:

a. a pass through securing means (15) proximal the pressure vessel top (11)

b. a pressure relief valve (30) in pressure communication from the pressure vessel interior (13) to the atmosphere positioned in the pressure vessel (10) intermediate the pressure vessel top(11) and pressure vessel bottom (12); the apparatus (1) supported by a support stand (40) having movement means including, wheels (50) and a handle (60);

c. the pressure inlet line (200) having a pressure inlet (210) which received pressure from a compressor means and associated piping (220), flex piping (230), valve means including a check valve (240) and ball valve (250) in piping and pressure communication interconnected to pressurize the pressure vessel (10);

d. the pass through pipe (400) is cylindrical and is contained within the pressure vessel (10) by piping and pressure containment means including O-Ring means with associated O-ring seats and retainer nut means; a pass through pipe "O" ring seat and thread means (450) provides a pass through pipe "O" ring seat aperture (455) which seatedly receives the pass through pipe "O" ring (470) with a pass through pipe "O" ring retainer nut (460) secured generally by removable nut/thread means to thread means at the pass through pipe "O" ring seat and thread means (450);

e. the pass through pipe "O" Ring (470) has a pass through pipe "O" ring ID D6 (475); the pass through pipe (400) is received at the pressure vessel top (11) pass through pipe "O" ring retainer (460), the pass through pipe "O" ring (470) and the pass through pipe "O" ring seat aperture (455); the pass through pipe (400) is in pressure sealing communications with the pass through pipe "O" ring (470) to permit pressurization of the pressure vessel (10);

f. the pass through pipe (400) is movable or slidably related to the pass through pipe "O" ring (470) allowing the pass through pipe (400) to be urged upward as pressure is applied to the pressure vessel (10) and the pass through pipe (400) and downwardly when pressure is released from the pressure vessel via the pressure relief valve (30); pass through securing means (15) comprised of pass through retaining nut (15);

g. pressure is introduced to the pass through pipe (400) by pipe connection means between the pass through pipe (400), at the pass through pipe top (440) proximal the pressure vessel top (11), and the pressure inlet line (200) piping (220) proximal the pressure vessel top (11) where pipe connection means includes Pipe Nipples and Fittings and Pipe Tees; the pressure inlet line (200) has a flexible piping means provided by flex piping (230), proximal the interconnection of the pass through pipe (400) and the pressure inlet line (200) such that movement of the pass through pipe (400) will not be constrained by the pressure inlet line (200);

h. the pressure inlet line (200) is affixed by pipe hanging means to the pressure vessel (10) or related support stand (40) or handle (60) structure by bracket or pipe having means including by one or more pressure inlet line support (260) generally comprised of a rigid material connected by mechanical means, including welding and brackets, to the pressure vessel (10) or support stand (40) and piping (220);

i. the pressure vessel (10), the pass through pipe (400), the venturi (500), the medium outlet (600) and the medium outlet elbow (700) are constructed of rigid pressure containing materials including metals and including stainless steel;

j. the pass through pipe (400), the venturi (500), the medium outlet (600) and the medium outlet elbow (700) are cylindrical with each generally having the same cross-section shape;

k. the venturi (500) at the venturi top (510) is aligned with and affixed, by mechanical means, including piping and threaded pipe, in pressure communication with the pass through pipe (400) at the pass through pipe bottom (445); the at least one venturi groove (530) is comprised of at least four venturi groove (530);

l. the medium outlet (600) is generally cylindrical; and is formed with the same cylindrical cross section as composes the venturi (500); the medium outlet (600) is affixed by pressure containing means including piping at the pressure vessel bottom (12); pressure containing means includes piping, welding and threaded means in the pressure vessel (10) at the pressure vessel bottom (12); the medium outlet (600) is composed of pipe having a medium outlet flange (610) with medium outlet pressure vessel threads (630) which are pressure sealing received by threaded means in the pressure vessel bottom (12);

m. the venturi aperture (590), in pressure communication with the pass through pipe (400), has a venturi aperture ID D6 (585) which is less than the pass through pipe ID D7 (410) thus creating a venturi when pressure is introduced into the pass through pipe (400) and allowed to pass through the venturi (500) and be discharged through the medium outlet (600) and a medium outlet elbow (700) to be received by a hose (800) and nozzle (900);

n. the venturi (500) proximal the venturi top (510) is chamfered at the venturi aperture (590) thus reducing pressure and flow restrictions as fluid flows through the pass through pipe (400) and into and through the venturi aperture (590);

o. the blasting medium (70) ranges from fifteen thousandths inches to approximately seven thousandths inches; the pressure in the pressure vessel interior (13) and in the pass through pipe (400) is approximately 150 psi;

p. the pass through pipe (400) machine trued to a range of three to eight thousandths inches; the machine truing of the pass through pipe (400) allows ease of assembly of the pass through pipe (400) as it is received by the pass through pipe "O" ring (470) which both retains pressure in the pressure vessel (10) and allows a slidable relationship with the pass through pipe (400) for upward and downward movement of the pass through pipe (400) and the venturi (500).

6. The apparatus of claim 5 further comprising:

a. the greater pressure of pipe pressure Pa (480) over that within the venturi (500) at the venturi aperture (590) exerts an upward force urging the pass through pipe (400), and attached venturi (500), upward toward the pressure vessel top (11); the upward movement of the pass through pipe (400) and venturi (500) causes an upward movement of the at least one venturi groove (530) relative to the fixed in place medium outlet (600); the pressure within the medium outlet (600) proximal the venturi bottom (520) is less than the pressure in the pressure vessel interior (13) thus causing pressure to be exerted on and urging the blasting medium (70) through the at least one venturi groove (530), into and through the medium outlet (600) and medium outlet elbow (700) and through the hose for application by the nozzle against a surface, b. the medium outlet ID D5 (650) is at least three thousandths inches (0.003") greater than the venturi diameter OD (570); the blasting medium is approximately nine thousandths inches (0.009") in diameter at its smallest dimension;

c. the upward movement of the pass through pipe (400) is limited by a position adjustment (300) means comprised of a position adjustment bracket (310) affixed by mechanical means, including welding, to the pressure vessel (10); the position adjustment bracket (310) receives a position adjustment stem (320) and a position stop (330); the position adjustment stem (320) and the position stop (330) are comprised of aligned rods with the position stop (330) attached by piping or other mechanical means proximal the pass through pipe top (440) to cause the position stop (330) to move in accord with the pass through pipe (400);

d. as the pass through pipe (400) is urged upwards, the position stop (330) encounters the position adjustment stem (320) and terminates upper movement of the pass through pipe (400); the position adjustment stem (320) is a downwardly extending elongated member and the position stop (330) is an upwardly extending elongated member, both comprised of a rigid material generally metal; the position stop (330) at its most upward position will have a concave surface and the position adjustment stem (320), at its most downward position will have a convex surface such that the contact between the two will be to retain the members in alignment;

e. the pass through pipe (400) interconnection, by pipe connection means, between the pass through pipe (400), at the pass through pipe top (440) proximal the pressure vessel top (11), and the pressure inlet line (200) piping (220) proximal the pressure vessel top (11) may be by use of a Pipe Tee means at the interconnection of the pass through pipe top (440) and the pressure inlet line (200) piping (220) proximal the pressure vessel top (11) where the cross member of a Pipe Tee means most distal to the pressure vessel top (11) may receive, by thread means, the position stop (330) for alignment with the position adjustment stem (320); the Tee portion of a Pipe Tee means may receive, by thread means, the piping (220) most proximal the pass through pipe top (440);

f. the position adjustment stem (320) has threaded means comprising position adjustment threads (340) which are received by threaded means in the position adjustment bracket (310); handle means comprising position adjustment handle (350) allow upward and downward adjustment of the position adjustment stem (320) thereby fixing the extent of upward movement of the pass through pipe (400).

7. The apparatus of claim 6 further comprising:

a. the at least one pass through pressure aperture (430) having a diameter of 0.1" to 5/32";

b. the venturi (500) has as least "n" venturi grooves (530);

c. the pass through pipe ID D7 (410) is 1.0", the venturi diameter OD D3 (570) is 1.060", the venturi aperture ID D6 (585) is 0.5", the medium outlet ID D5 (650) is 1.065", the medium elbow outlet ID D8 (750) is 1.000", the hose (800) is 0.75" ID, and the nozzle (900) ID ranges from 1/8" to 3/8"; the venturi (500) movement is a maximum of 1.000 inches upward from a closed position of no flow;

d. a medium outlet elbow interior (720) has rifling means comprising medium outlet elbow rifling (740) formed by rifling means thereby creating a cyclonic medium outlet stream;

e. the venturi groove second depth D2 (565) proximal the venturi top (510) is 0.000" allowing metering of blasting medium (70) to the closed position of no flow, f. the at least one venturi groove (530) composed of at least four venturi grooves (530) each having a venturi groove height H and comprising venturi groove first height H1 (566), venturi groove second height H2 (567), venturi groove third height H3 (568) and venturi groove fourth height H4 (569) which extend from the venturi bottom (520) on the venturi outer surface (525) toward the venturi top (510) and terminates intermediate the venturi top (510) and the venturi bottom (520); venturi groove first height H1 (566), venturi groove second height H2 (567), venturi groove third height H3 (568) and venturi groove fourth height H4 (569) are equal or unequal in height; at least one venturi flat (522) proximal the venturi bottom (520) for wrench tighting means.

8. The apparatus of claim 7 further comprising:

a. the at lease four venturi grooves (530) are formed at the venturi outer surface (525) in a staggered, unequally spaced or equally spaced arrangement.

9. The apparatus of claim 8 further comprising:

a. the venturi groove first width W1(550) and the venturi groove second width W2 (555) are 1/32" and the venturi groove first depth D1 (560) is 0.0 " and the venturi groove second depth D2 (565) is 1/16";

b. the pass through pipe (400) is twenty-six inches in length.

* * * * *